United States Patent [19]

Katz et al.

[11] 4,435,313

[45] Mar. 6, 1984

[54] ELECTRODE WITH OUTER COATING FOR EFFECTING AN ELECTROLYTIC PROCESS AND PROTECTIVE INTERMEDIATE COATING ON A CONDUCTIVE BASE, AND METHOD OF MAKING SAME

[75] Inventors: Michael Katz, Geneva; Jean M. Hinden, Chambesy; Jürgen F. Gauger, Le Lignon, all of Switzerland

[73] Assignee: Diamond Shamrock Corporation, Dallas, Tex.

[21] Appl. No.: 293,381

[22] Filed: Aug. 17, 1981

[30] Foreign Application Priority Data

Aug. 18, 1980 [GB] United Kingdom ..... 8026830
Apr. 9, 1981 [GB] United Kingdom ..... 8111257

[51] Int. Cl.[3] ..... C25B 11/16; C25B 11/08

[52] U.S. Cl. ..... 502/101; 204/290 R; 204/290 F; 427/126.5; 429/42

[58] Field of Search ..... 252/425.3; 204/290 R, 204/290 F, 290 K; 427/126.5; 429/42

[56] References Cited

U.S. PATENT DOCUMENTS 4,118,294 10/1978 Pellegri ..... 204/129

FOREIGN PATENT DOCUMENTS 2723406 5/1977 Fed. Rep. of Germany ... 204/290 K
2714605 10/1978 Fed. Rep. of Germany ... 204/290 K
49-40050 10/1974 Japan ..... 204/290 K
51-70187 6/1976 Japan ..... 204/290 K

OTHER PUBLICATIONS

Kokhanov et al., Translation of Elektro Khimiya, vol. 9, No. 1, pp. 30–33, 1/73.

*Primary Examiner*—F. Edmundson
*Attorney, Agent, or Firm*—John P. Hazzard; Donavon L. Favre

[57] ABSTRACT

An electrode with an outer coating for effecting an electrolytic process is provided with a protective intermediate coating consisting of a conducting insoluble polymer network formed in situ on a titanium base and containing a small amount of finely dispersed platinum group metal catalyst.

A method of manufacturing the electrode comprises applying to the titanium base several layers of a solution containing a polymer precursor and a platinum metal compound which are thermally converted to the protective polymer coating, on which the outer coating is formed, more particularly by electrodepositing manganese dioxide or lead dioxide.

The polymeric intermediate coating serves to protect the titanium base from oxidation, and to more particularly provide stable electrode performance with economical use of precious metal.

8 Claims, No Drawings

ELECTRODE WITH OUTER COATING FOR EFFECTING AN ELECTROLYTIC PROCESS AND PROTECTIVE INTERMEDIATE COATING ON A CONDUCTIVE BASE, AND METHOD OF MAKING SAME

FIELD OF INVENTION

The invention generally relates to electrodes for electrolytic processes and the manufacture of such electrodes comprising an outer coating for effecting an electrolytic process, a protective intermediate coating and an electrically conductive base.

BACKGROUND ART

Electrodes for use in industrial electrolysis cells must generally meet a combination of strict requirements with regard to conductivity, physical and chemical stability, corrosion resistance, manufacture and electrochemical performance, more particularly catalytic activity and selectively.

However, there is no known material which can meet all of these requirements for satisfactory performance of industrial electrodes. The very few materials which are able to withstand severe anodic attack can generally not be used alone to produce electrodes with adequate electrochemical performance under industrial operating conditions. Consequently, various types of composite electrodes comprising different combinations of materials have been proposed, in order to be able to meet as far as possible the various technical and economic requirements for providing adequate industrial performance.

Various types of electrodes comprising a catalytic coating on a metal base have been proposed, as may be seen from the numerous patents relating to such electrode coatings.

An outstanding success in this field is the dimensionally stable anode, known under the tradename DSA and described e.g. in U.S. Pat. No. 3 632 498, which comprises a catalytic coating consisting of titanium-ruthenium oxide formed on a titanium base, and which has fundamentally changed the chlorine industry throughout the world in the past decade.

An electrode base of titanium is preferred because titanium and other suitable valve metals can exhibit extremely high corrosion resistance due to their film forming properties whereby a protective oxide film is formed under anodic operating conditions.

Platinum group metals are known to provide excellent electrocatalysts for different electrode reactions but their high cost makes it necessary to use them as sparingly as possible, and more particularly to replace them by cheaper electrode materials whenever possible. Ruthenium is of particular interest due to its relatively low cost and availability with respect to the other platinum group metals.

The dimensionally stable anode (DSA) mentioned above exhibits excellent, stable performance with a long service life in chlorine production cells. This DSA must, however, be manufactured and operated under controlled conditions in order to avoid the formation of an insulating titanium oxide layer on the electrode base, which would result in electrochemical passivation of the anode with an excessive rise of its operating potential.

Another anode, as described e.g. in U.S. Pat. No. 3 776 834 comprises a catalytic coating with tin replacing about one half of the ruthenium normally contained in the standard coating of the titanium-ruthenium oxide of said DSA. This anode with partial replacement of ruthenium by tin exhibits a higher oxygen overvoltage and an improved resistance to oxidation in presence of anodically generated oxygen than thhe standard DSA currently used in the chlor-alkali industry.

Various inexpensive electrode materials based on non-noble metals have been proposed but their use has nevertheless remained relatively restricted for various reasons.

Lead dioxide is also a promising stable, inexpensive anode material for various processes, but massive lead dioxide anodes exhibit inadequate conductivity. On the other hand, lead dioxide coatings formed on an electrode base have generally not provided satisfactory stable performance with a high service life in industrial operation. The state of the art relating to lead dioxide electrodes, their manufacture, and use, may be illustrated by U.S. Pat. Nos. 4 040 039, 4 026 786, 4 008 144, 3 751 301, 3 629 007 and U.K. Pat. Nos. 1 416 162, 1 378 884, 1 377 681.

Manganese dioxide also shows great promise as a stable, inexpensive anode material, especially for oxygen evolution in processes for electrowinning metals from acid solutions. Its widespread use has nevertheless been hindered hitherto by manufacturing difficulties: the manufacture of satisfactory massive electrodes consisting entirely of manganese dioxide has not been possible, while manganese dioxide coatings formed on an electrode base have generally not provided satisfactory stable performance with a high industrial service life.

Lead dioxide and manganese dioxide coatings may be produced by thermal decomposition of metal salts deposited on the electrode base forming the coating substrate, but the resulting oxide coating is nevertheless generally quite porous and has poor adherence to the base. On the other hand, more compact oxide coatings with better adherence may be produced by electrodeposition on the electrode base, but they are nevertheless porous and generally still provide inadequate protection of the electrode base from oxidation.

It has moreover been proposed to provide the metal electrode base with an intermediate protective coating which is covered with an outer coating of lead or manganese dioxide. The state of the art relating to such intermediate protective coatings may be illustrated by U.S. Pat. Nos. 4 028 215, 4 125 449, 4 040 937 (Sn/Sb oxide subcoating); Japanese Patent Application No. 51-156740, publication No. 53-79771 and Electrochimica Acta Vol. 23, p. 331-333 (Pt Group metal oxide subcoating); U.S. Pat. No. 4 072 586 ($RuO_2/TiO_2$ subcoating); U.S. Pat. No. 4 180 445 ($TiO_2/SnO_2/RuO_2$ subcoating); and U.S. Pat. No. 4 060 476 (TiN subcoating).

Such intermediate protective coatings must form an effective barrier against oxidation of the electrode base and must meet various requirements for this purpose with regard to adherence, conductivity, cost, impermeability, resistance to oxidation, physical and chemical stability. This particular combination of properties is nevertheless difficult to achieve in industrial practice.

Various proposals have also been made to use polymeric materials in the production of electrodes. Thus, for example, according to U.S. Pat. No. Reissue 29419, a catalytic composite coating formed on a valve metal base, comprises ruthenium dioxide finely dispersed in an organic polymer intended to serve as a binder for mechanical support of the dispersed electrocatalyst, adhesion to the underlying base, and protection thereof. The ruthenium dioxide is prepared in the form of extremely fine particles of less than 0.1 micron size and uniformly dispersed in the polymer in a weight ratio of 6:1 to 1:1 to provide the electrical and catalytic properties of the coating. The conductivity of such a composite coating will thus depend essentially on the amount of dispersed electrocatalyst, on its particle size and on its distribution in the polymer (binder). The state of the art relating to electrodes comprising polymeric materials may further be illustrated by U.S. Pat. Nos. 3 626 077, 3 751 301, 4 118 294, 3 972 732, 3 881 957, 4 090 979 and the laid-open German Patent Application, Offenlegungsschrift No. 2 035 918.

The service life of coated electrodes such as those mentioned above is nevertheless generally limited when they are operated industrially in presence of a notable anodic generation of oxygen. A particular problem in this connection is that of ensuring adequate protection of the electrode base from attack by oxidation leading to electrode failure due to corrosion or electrochemical passivation of the base.

It may thus be seen from the foregoing that, in addition to the choice of suitable electrode materials, the production of electrodes with satisfactory, long-term performance in industrial electrolytic processes is generally quite problematic and presents complex technological problems.

DISCLOSURE OF INVENTION

An object of this invention is to provide electrodes for electrolytic processes, which comprise a conductive base, a stable outer coating for effecting an electrolytic process, and an intermediate, conducting coating which ensures satisfactory protection of the electrode base from oxidation, which adheres well to said base, to which said outer coating adheres well, and which remains stable, under the industrial operating conditions for which the electrode is intended.

Another object of the invention is to provide such electrodes with a protective intermediate coating which can be manufactured on the electrode base without difficulty, and which allows the outer coating to be subsequently manufactured in a satisfactory manner without any deterioration of the intermediate coating or the electrode base.

A further object of the invention is to provide such an electrode with an improved oxidation resistance, a long service life and stable electrochemical performance under industrial operating conditions.

Another object of the invention is to provide an electrode with such an intermediate coating formed on a corrosion resistant valve metal base.

A further object of the invention is to provide an electrode with a valve metal base which is protected from passivation by means of such an intermediate coating containing a platinum group metal in an amount which is reduced as far as possible and advantageously corresponds to less than 2 $g/m^2$ of the electrode base, and preferably to less than 1 $g/m^2$.

Another object of the invention is to provide such electrodes with a minimum overall amount of precious metal incorporated in the electrode.

A further object of the invention is to provide an electrode with such a protective intermediate coating and a catalytic outer coating of manganese dioxide.

Another object of the invention is to provide an electrode with such a protective intermediate coating and an outer coating of lead dioxide.

A further object of the invention is to provide a simple manufacturing process for the production of electrodes with such a protective intermediate coating.

The above mentioned objects are essentially met by the invention as set forth in the claims.

The invention essentially provides electrodes with an outer coating for carrying out an electrolytic process and a protective polymeric intermediate coating comprising a conducting insoluble polymer network, or matrix, formed in situ on a conductive electrode base, which may consist advantageously of titanium, or any other suitable valve metal which can form a protective film under the operating conditions for which the electrode is intended in each case.

This protective polymeric intermediate coating of the electrode according to the invention may advantageously comprise a conductive material finely dispersed throughout said conducting, insoluble polymer network formed in situ on the electrode base. This finely dispersed conductive material may advantageously be a catalyst for oxygen evolution, which comprises at least one of the platinum group metals; iridium, ruthenium, rhodium, platinum, which is advantageously in the form of an oxide, and is preferably likewise formed in situ at the same time as said conducting insoluble network. The loading of said platinum group metal catalyst finely dispersed in said polymeric protective coating, per unit area of the electrode base, corresponds preferably to 0.1 to 2 $g/m^2$.

Said conducting polymer network of the protective intermediate coating may be advantageously formed in situ from polyacrylonitrile, polybenzoxazole, or poly-p-phenylene.

Said protective polymeric intermediate coating may be formed in a simple, well controlled manner by the method according to the invention as set forth in the claims.

The invention provides, as is more particularly set forth in the claims, an electrode with an outer coating of manganese dioxide electrodeposited on a protective polymeric intermediate coating on a conductive electrode base, as well as a method for its manufacture.

The invention also provides, as is more particularly set forth in the claims, an electrode with an outer coating of lead dioxide electrodeposited on a protective polymeric coating on a conductive electrode base, as well as a method for its manufacture.

According to the method of the present invention, exactly predetermined amounts of a thermally decomposable metal compound and of an organic polymer precursor may be advantageously applied by means of a homogeneous solution to the electrode base. The solution may thus be applied in as many layers as may be necessary to produce said protective polymeric intermediate coating in accordance with the invention.

A platinum group metal or its oxide may thus be dispersed as uniformly and as finely as possible and in an exactly predetermined proportion in the conducting insoluble polymer network formed in situ after heat treatment.

After drying the layers of solution applied to the electrode base, heat treatment may be advantageously effected in one or several controlled stages at temperatures lying between 250° C. and 450° C., in a suitable oxidizing atmosphere such as air for example. Each dried layer may be advantageously subjected to a first, individual heat treatment stage at a temperature lying preferably between 250° C. and 300° C. After applying and heat treating the last layer, at least one further common heat treatment stage may be carried out advantageously at a higher temperature lying between 300° C. and 500° C. for a period lying between 5 and 10 minutes, but which may be increased up to 10 hours or more in some cases, in order to improve the conductivity and stability of said polymer network.

The protective conducting polymeric intermediate coating according to the invention forms a stable, conducting, relatively impermeable barrier layer which effectively protects the underlying metal base from oxidation, during manufacture of the electrode as well as its subsequent operation. The conducting insoluble polymer network formed in situ on the electrode base moreover forms a stable conducting matrix which is in intimate contact with the conductive material finely dispersed therein, which exhibits a relatively low electrical resistance, and adheres well to the electrode base, so that it constitutes an effective oxidation barrier, without at the same time unduly increasing the electrode potential.

It has been experimentally established that relatively thick, adherent, compact layers of manganese dioxide corresponding to a loading of the order of 500 g/m$^2$ of the electrode base area can be successfully electrodeposited on a protective polymeric precoating of an electrode according to the invention, so as to provide a high anode lifetime during oxygen evolution in an acid electrolyte, such as is used for example for electrowinning metals. The electrodeposited manganese dioxide is advantageously subject to a thermal post-treatment, for example at 400° C. for 20–30 minutes, in order to provide improved catalytic performance of the electrode.

BEST MODE OF CARRYING OUT THE INVENTION

The invention is illustrated by the following examples with reference to the tables given below.

EXAMPLE 1

Electrode samples comprising a manganese dioxide coating and a protective intermediate coating on a titanium base were prepared and tested in the following manner. Table 1 below provides data corresponding to each sample.

Titanium plates (100×20×1 mm) were first pretreated to provide a micro-rough surface by sand-blasting and then etching in 10% oxalic acid at 85° C. for 6 hours.

A homogeneous precoating solution (P15) was prepared by mixing a solution comprising polyacrylonitrile (PAN) dissolved in dimethylformamide (DMF) with a solution comprising $IrCl_3$ aq. dissolved in isopropylalcohol (IPA) with a small addition of concentrated HCl. This precoating solution P15 contained 16.4 mg PAN and 14.7 mg Ir (calculated as metal) per gram of the solution.

A semi-conducting polymeric coating was formed by applying the precoating solution in successive layers to the pretreated titanium samples, drying each layer in an oven at 100° C. for 5 minutes, then effecting a first heat treatment I (described below) after drying each applied layer, and generally further effecting one or two additional, common heat treatments (II,III) carried out in an air flow of 60 l/h.

The first heat treatment I was generally effected at 250° C. for 10 minutes in stationary air.

In the case of sample K6, K13, K22, 054, it was effected at 400° C. for 10 minutes in an air flow of 60 l/h, and in the case of K4 and 12.80, at 400° C. for 10 minutes in an air flow of 90 l/h.

Table 1 below gives the reference of each electrode sample, the type of precoating solution (P15), the number of times it was applied (No. Layers), the total loading of polymer (PAN), Ir, the temperature and duration of heat treatments II and III.

The titanium samples were thus precoated with a thin, solid protective coating formed of an insoluble, semi-conducting matrix containing finely dispersed iridium and adhering firmly to the titanium substrate.

The precoated samples were further topcoated with manganese dioxide which was anodically deposited from an electrolysis bath of 2 M $Mn(NO_3)_2$ aqueous solution at 95° C. The manganese dioxide was generally electrodeposited by passing an electrolysis current with an anode current density corresponding to 1.5 mA/cm$^2$, for 20–25 hours in most cases, and 40–45 hours in the case of samples 12.8, 054 and K22. This electrodeposition was effected on samples G90 and K4 in two stages at a higher current density, namely on G90 at 3.9 mA/cm$^2$ for 10 minutes, then at 7.7 mA/cm$^2$ for 2 hours, and on K4 at 7.7 mA/cm$^2$ for 30 minutes and then at 15 mA/cm$^2$ for 2 hours.

In the case of sample K22, 4 layers of an aqueous solution Mn4, comprising 5 g $Mn(NO_3)_2$, 4.5 ml $H_2O$, 0.5 ml ethyl alcohol, were first applied to the precoated sample, each layer was dried and heat treated at 400° C. for 10 minutes in air to form a thin manganese dioxide layer, prior to the electrodeposition described above.

The third column in Table 1 indicates the corresponding loading or specific amount of manganese dioxide electrodeposited on each precoated sample per unit area of the titanium plate surface.

In order to improve the electrode performance, the manganese dioxide topcoating was heat treated at 400° C. in an air flow of 60 l/h for 20 minutes in most cases, and for 30 minutes in the case of sample 054, 12.80 and K13.

The electrode samples, thus provided with a protective precoating and a catalytic topcoating of $MnO_2$, were finally subjected to an electrolytic test as an oxygen-evolving anode in a breaker containing 150 g/l $H_2SO_4$ aqueous solution. The initial anode potential (AP) was determined in each case with respect to a normal hydrogen electrode (NHE), but without correction for ohmic drop. The duration of each electrolytic test is indicated in the last column in Table 1 above and is underlined whenever anode failure occurred (with a steep potential rise). The anode current density (ACD) applied in each test and the corresponding measured anode potential (AP) are also indicated in Table 1.

A comparison of the data shown in Table 1 provides more particularly the following indications which are of interest for providing electrodes with improved performance in accordance with the invention.

An accelerated test lifetime of about 4000 hours operation at 2500 A/m$^2$ as an oxygen evolving anode in 150 g/l $H_2SO_4$ was achieved with samples G79, G92, K13 comprising a polymeric precoating with 2 g Ir/m$^2$ and a topcoating with about 300 g $MnO_2$/m$^2$.

Sample G92 subjected to a final heat treatment III for 10 minutes at 400° C. exhibited at 2500 A/m$^2$ a test lifetime of 4300 hours. This is significantly higher than the 2750 hours achieved with sample G77 which was subjected to a final heat treatment III at 370° C., but was otherwise prepared and tested under practically the same conditions.

Sample 4.80 subjected to a final heat treatment III at 400° C. for 7.5 minutes exhibited at 4500 A/m² a test lifetime of 1180 hours, which is notably higher than the 930 hours achieved with sample 6.80 which underwent a heat treatment III at 400° C. for 5 minutes, but was otherwise prepared and tested under similar conditions (except that 6 layers of P15 were applied on 4.80 instead of 5 layers on 6.80).

The first common heat treatment II was effected at 300° C. on samples 6.80, 4.80, G92, G77, I24, for a period which varied between 10 and 30 minutes, but this variation of its duration appears to be of secondary importance.

Variation of the iridium loading in the precoating from 1 to 2 g Ir/m² and of the manganese dioxide loading from about 300 to 400 g/m² showed no major influence of these variations on the anode performance.

Sample G90 exhibited a shorter test lifetime of 1150 hours which may be due, either to the lower $MnO_2$ loading of 190 g/m², or to the higher current density applied during $MnO_2$ electrodeposition in this case, or to both.

Samples 12.80 and 054, which were subjected to prolonged heat treatment of 400° C. (II for 1620 minutes on sample 12.80 and III for 1080 minutes on sample 054) and also had high manganese dioxide loadings of 940–1020 g/m², exhibited high test lifetimes of about 1500–1800 hours at 7500 A/m², as compared to 980 hours for sample K22.

A precoating solution P15a used in this case contained 18.6 mg PAN and 7.0 mg Ir per gram of this solution P15a (prepared in the same way as P15 in Example 1).

The first heat treatment (I) was effected at 300° C. for 7 minutes in an air flow of 60 l/h. The common heat treatment II at 400° C. for 20 minutes was effected in an air flow of 60 l/h.

The manganese dioxide was electrodeposited on all samples in a single step, as described in Example 1.

Table 2 below shows the corresponding data for each sample in the same way as in Table 1.

Comparison of the data given for the samples in Table 2 provides the following indications of interest for producing improved electrodes in accordance with the invention.

Sample C51 exhibited a test lifetime of 11300 hours at 500 A/m², which corresponds to more than 15 months operation with a current density lying in the range of interest for operation of an oxygen evolving anode in an industrial metal electrowinning process.

On the other hand, samples ME14, Me13 and Sm31, which were respectively tested at higher current densities of 1000, 2500 and 7500 A/m², exhibited significantly reduced accelerated test lifetimes of 6700, 3250, and 760 hours, as would be generally expected from an increase of the test current density.

Sample Me10 with 424 g $MnO_2$/m² exhibited an accelerated test lifetime of 3000 hours at 2500 A/m², while sample F49 with 207 g $MnO_2$/m² exhibited a lifetime of 530 hours, the only difference in preparation of these samples being that the precoating of Me10 was subjected to a common heat treatment II at 400° C. for 20 minutes, whereas F49 only underwent heat treatment I (at 300° C. for 7 minutes), and had a lower $MnO_2$ loading.

Comparison of samples Sm30 and Sm31, shows that Sm30 with 1.5 g Ir/m² exhibits a lower anode potential

TABLE 1

| | COATING | | HEAT TREATMENT | | ELECTROLYTIC TEST | | |
|---|---|---|---|---|---|---|---|
| | Precoat. | | | | | | |
| REFERENCE | Soln. × No. layers | Loading g/m² | II °C./min | III °C./min | ACD A/m² | AP V/NHE | Time h, |
| 6.80 | P15 × 5 $MnO_2$ | 2.2 PAN/2.0 Ir 398 $MnO_2$ | 300/30 | 400/5 | 4500 | 1.90-X | 930 |
| 4.80 | P15 × 6 $MnO_2$ | 2.2 PAN/2.0 Ir 385 $MnO_2$ | 300/30 | 400/7.5 | 4500 | 2.06-X | 1180 |
| K6 | P15 × 5 $MnO_2$ | 1.2 PNA/1.0 Ir 340 $MnO_2$ | — | — | 4500 | 1.97-X | 1450 |
| G79 | P15 × 9 $MnO_2$ | 2.2 PAN/2.0 Ir 340 $MnO_2$ | 400/10 | — | 2500 | 1.90-X | 4040 |
| G92 | P15 × 9 $MnO_2$ | 2.2 PAN/2.0 Ir 302 $MnO_2$ | 300/10 | 400/10 | 2500 | 1.85-X | 4300 |
| K13 | P15 × 8 $MnO_2$ | 2.2 PAN/2.0 Ir 293 $MnO_2$ | — | — | 2500 | 1.95-X | 4000 |
| G77 | P15 × 9 $MnO_2$ | 2.2 PAN/2.0 Ir 280 $MnO_2$ | 300/30 | 370/10 | 2500 | 1.92-X | 2750 |
| G90 | P15 × 9 $MnO_2$ | 2.2 PAN/2.0 Ir 190 $MnO_2$ | 400/20 | — | 2500 | 1.82-X | 1150 |
| I24 | P15 × 5 $MnO_2$ | 1.2 PAN/1.0 Ir 296 $MnO_2$ | 300/15 | 400/5 | 2500 | 1.96-X | 3500 |
| K4 | P15 × 5 $MnO_2$ | 1.2 PAN/1.0 Ir 550 $MnO_2$ | — | — | 2500 | 1.82-X | 3430 |
| 12.80 | P15 × 8 $MnO_2$ | 2.2 PAN/2.0 Ir 940 $MnO_2$ | 400/1620 | — | 7500 | 2.01-X | 1490 |
| 054 | P15 × 7 $MnO_2$ | 1.9 PAN/1.1 Ir 1020 $MnO_2$ | 400/30 | 400/1080 | 7500 | 2.05-X | 1780 |
| K22 | P15 × 8 Mn4 × 4 $MnO_2$ | 2.1 PAN/1.9 Ir 4.4 $MnO_2$ 972 $MnO_2$ | 400/10 | — | 7500 | 2.07-X | 980 |

EXAMPLE 2

Electrode samples with a coating of manganese dioxide on a precoated titanium base were prepared and tested in the manner described in Example 1, unless indicated otherwise below.

and a higher accelerated test lifetime at 7500 A/m² than Sm31 with 0.5 g Ir/m².

Comparison of samples Me14, Me9 and Me12, shows that Me14 with 0.5 g Ir/m² failed after 7600 hours at 1000 A/m², while M9 with 1 g Ir/m² and M12 with 1.5 g Ir/m² were still operating respectively after 9120 hours and 9760 hours.

TABLE 2

| REFERENCE | COATING Precoat. Soln. × No. Layers | COATING Loading g/m² | HEAT TREATMENT II °C./min | HEAT TREATMENT III °C./min | ELECTROLYTIC TEST ACD A/m² | ELECTROLYTIC TEST AP ZN/NHE | ELECTROLYTIC TEST Time h |
|---|---|---|---|---|---|---|---|
| Me11 | P15a × 6 $MnO_2$ | 3.75 PAN/1.5 Ir 473 $MnO_2$ | 400/20 | — | 2500 | 1.86-X | 3800 |
| Me12 | P15a × 6 $MnO_2$ | 3.75 PAN/1.5 Ir 460 $MnO_2$ | " | — | 1000 | 1.75-1.92 | 9760* |
| C51 | P15a × 4 $MnO_2$ | 2.0 PAN/0.8 Ir 275 $MnO_2$ | — | — | 500 | 1.70-X | 11300 |
| F49 | P15a × 4 $MnO_2$ | 2.5 PAN/1.0 Ir 207 $MnO_2$ | — | — | 2500 | 1.77-X | 530 |
| Me14 | P15a × 2 $MnO_2$ | 1.25 PAN/0.5 Ir 445 $MnO_2$ | 400/20 | — | 1000 | 1.77-X | 6700 |
| Me9 | P15a × 4 $MnO_2$ | 2.50 PAN/1.0 Ir 461 $MnO_2$ | " | — | 1000 | 1.65-1.88 | 9120* |
| Sm29 | P15a × 4 $MnO_2$ | 2.50 PAN/1.0 Ir 466 $MnO_2$ | " | — | 7500 | 1.96-X | 558 |
| Sm30 | P15a × 6 $MnO_2$ | 3.75 PAN/1.5 Ir 474 $MnO_2$ | " | — | 7500 | 1.88-X | 893 |
| Sm31 | P15a × 2 $MnO_2$ | 1.25 PAN/0.5 Ir 478 $MnO_2$ | " | — | 7500 | 1.96-X | 760 |
| Me10 | P15a × 4 $MnO_2$ | 2.50 PAN/1.0 Ir 424 $MnO_2$ | " | — | 2500 | 1.78-X | 3000 |
| Me13 | P15a × 2 $MnO_2$ | 1.25 PAN/0.5 Ir 445 $MnO_2$ | " | — | 2500 | 2.04-X | 3250 |

EXAMPLE 3

Electrode samples comprising a manganese dioxide coating on a precoated titanium base were prepared and tested in the manner described in Example 1, unless indicated otherwise below.

The following precoating solutions used in this case were prepared as in Example 1 but contained different amounts of polymer, $IrCl_3$, $PtCl_4$ and $RuCl_3$, corresponding to the amounts of polymer (PAN) and noble metal per gram of solution which are indicated below:

P59: 16.4 mg PAN/4.4 mg Ir/10.3 mg Pt
P54: 17.3 mg PAN/14.6 mg Pt
P37: 18.6 mg PAN/6.5 mg Ru
P58: 10.0 mg PAN/6.0 mg Ru/2.0 mg Ir
P15e: 17.9 mg PAN/9.6 mg Ir

The first heat treatment I was effected at 250° C. for 10 minutes as described in Example 1, except for sample I22 which each applied layer was heat treated at 400° C. for 7.5 minutes in an air flow of 60 l/h. The latter treatment I was also effected on the layer of P15e applied first on sample 44.80.

Manganese dioxide was generally electrodeposited in one stage at 1.5 mA/cm² as described in Example 1. In the case of sample W78, electrodeposition was effected in two stages, namely at 2 mA/cm² for 50 minutes and then at 5 mA/cm² for 5 hours. In the case of sample P41/1, two layers of manganese dioxide were alternately applied in a sandwich-like arrangement with two polymeric precoatings. The first $MnO_2$ layer was electrodeposited at 7.65 A/cm² for 120 minutes, so as to decrease the resistance of this intermediate electrodeposited layer.

Table 3 below shows the corresponding data for each sample in the same way as in the preceding tables 1 and 2.

As is indicated in Table 3, sample 44.80 was provided with a thin layer of manganese dioxide (3.2 g $MnO_2$/m²) by applying solution Mn4 followed by heat treatment under the conditions described in Example 1 with reference to sample K22.

The sensitivity of sample N34X to fluoride ions was tested by adding in this case 10 ppm $F^-$ to the sulphuric acid used in the electrolytic test.

A comparison of the data shown in Table 3 provides the following indications of interest with regard to the performance of electrodes in accordance with the invention.

All samples comprising iridium in the polymeric precoating exhibited better performance than samples I21 and D68 which respectively comprised only platinum and ruthenium.

Moreover, samples 4P80, 25.80, 46.80, N34X, W78, W79, 44.80, P41/1, which were precoated with solution P58 with a Ru/Ir ratio of 3/1, exhibited high accelerated test lifetimes. Such a substantial replacement of iridium by ruthenium is particularly attractive in view of the considerably lower cost and greater availability of ruthenium.

Sample 46.80 with a very low iridium loading of 0.13 g/m², 0.4 g Ru/m², and a high manganese dioxide loading of 950 g/m² exhibited a high accelerated test lifetime of 1390 hours at 7500 A/m².

Sample N34X, which underwent an additional, prolonged common heat treatment (III) at 400° C. for 360 minutes, exhibited an accelerated test lifetime of 980 hours at 7500 A/m², and that in the presence of 10 ppm $F^-$ in the acid electrolyte.

Comparison of samples W78 and W79, which were similarly prepared and tested, except for electrodeposition on W78 in two stages as described, shows no appreciable difference between the accelerated test lifetimes at 2500 A/m² as a result of the different electrodeposition conditions applied.

Sample P41/1 shows that the polymeric precoating and manganese dioxide coatings can be alternately applied twice to provide a high total manganese loading (720 g/m²) with a low total iridium loading (0.26 g/m²) and that this leads to a high accelerated test lifetime of 1570 hours at 7500 A/m². It is understood that this procedure may be repeated more than twice, and in fact as many times as may be suitable to provide improved results.

TABLE 3

| REFERENCE | COATING Precoat. Soln. × No. Layers | Loading g/m² | HEAT TREATMENT II °C./min | III °C./min | ELECTROLYTIC TEST ACD A/m² | AP V/NHE | Time h |
|---|---|---|---|---|---|---|---|
| I22 | P59 × 8 | 1.8 PAN/0.5 Ir/1.1 Pt | — | — | 2500 | 1.94-X | 1350 |
| | $MnO_2$ | 251 $MnO_2$ | | | | | |
| I21 | P54 × 7 | 1.5 PAN/1.3 Pt | 300/15 | — | 2500 | 1.91-X | 450 |
| | $MnO_2$ | 180 $MnO_2$ | | | | | |
| D68 | P37 × 14 | 6.2 PAN/2.1 Ru | 300/30 | — | 2500 | 1.90-X | 380 |
| | $MnO_2$ | 265 $MnO_2$ | | | | | |
| 4P80 | P58 × 4 | 1.6 PAN/0.9 Ru/0.3 Ir | 300/5 | 430/5 | 7500 | 1.95-X | 360 |
| | $MnO_2$ | 668 $MnO_2$ | | | | | |
| 25.80 | P58 × 4 | 1.0 PAN/0.6 Ru/0.2 Ir | 300/5 | 430/5 | 7500 | 1.93-X | 670 |
| | $MnO_2$ | 553 $MnO_2$ | | | | | |
| 46.80 | P58 × 5 | 0.65 PAN/0.4 Ru/0.13 Ir | 300/7.5 | 400/30 | 7500 | 2.03-X | 1390 |
| | $MnO_2$ | 952 $MnO_2$ | | | | | |
| N34X | P58 × 7 | 0.9 PAN/0.65 Ru/0.2 Ir | 300/7.5 | 430/7.5 | 7500 | 2.01-X | 980 |
| | $MnO_2$ | 980 $MnO_2$ | | 400/360 | (10 ppm $F^-$) | | |
| W78 | P58 × 4 | 0.18 PAN/0.11 Ru/0.04 Ir | 300/10 | 430/10 | 2500 | 1.81-X | 3255 |
| | P15 × 4 | 1.2 PAN/1.1 Ir | 400/10 | — | | | |
| | $MnO_2$ | 370 $MnO_2$ | | | | | |
| W79 | P58 × 4 | 0.18 PAN/0.11 Ru/0.04 Ir | 300/10 | 430/10 | 2500 | 1.89-X | 3380 |
| | P15 × 4 | 1.2 PAN/1.1 Ir | 400/10 | — | | | |
| | $MnO_2$ | 328 $MnO_2$ | | | | | |
| 44.80 | P15e × 1 | 0.44 PAN/0.24 Ir | — | — | 7500 | 2.00-X | 980 |
| | P58 × 6 | 0.90 PAN/0.54 Ru/0.18 Ir | 300/7.5 | 430/7.5 | | | |
| | Mn4 × 2 | 3.2 $MnO_2$ | | | | | |
| | $MnO_2$ | 563 $MnO_2$ | | | | | |
| P41/1 | P58 × 4 | 0.55 PAN/0.34 Ru/0.11 Ir | 300/10 | 430/10 | 7500 | 1.95-X | 1570 |
| | $MnO_2$ | 230 $MnO_2$ | | | | | |
| | P58 × 4 | 0.73 PAN/0.44 Ru/0.15 Ir | 300/10 | 430/10 | | | |
| | $MnO_2$ | 490 $MnO_2$ | | | | | |

EXAMPLE 4

Electrode samples comprising a coating of manganese dioxide on a precoated titanium base were prepared and tested in the manner described in Example 1, unless otherwise indicated below.

The precoating solution used in this example contained, as a polymer precursor, a polybenzoxazole (PBO) pre-polymer, which is readily soluble in organic solvents and more particularly in N-methyl-pyrollidone (NMP) as indicated below, and is thermally stable in presence of oxygen.

The solutions used for precoating the samples in this example had the following constituents, given in mg, per gram of solution:

PP6:

18.0 mg PBO in NMP
7.0 mg Ir (as $IrCl_3$ aq.)

PP7:

18.6 mg adamantane-based polybenzoxazole (PBO-DPA) in NMP
7.0 mg Ir (as $IrCl_3$ aq.)

PP8:

18.6 mg polybenzoxazole-imide (PBO-I) in NMP
7.0 mg Ir (as $IrCl_3$ aq.)

The first heat treatment I was carried out for 7.5 minutes at 250° C. in an air flow of 60 l/h.

A common heat treatment II was carried out under the conditions shown in Table 4 below in order to more particularly promote cyclization of the pre-polymer.

Table 4 shows the corresponding data in the same way as in the preceding tables.

The data shown in Table 4 indicates that samples Me3 and Me68 with respectively 1 and 0.5 g Ir/m² exhibit test lifetimes greater than 8600 and 6210 hours at 1000 A/m² while sample Me7 with 2 g Ir/m² exhibits a lower lifteime of 6000 hours.

Sample Sm26 with 0.5 g Ir/m² moreover exhibits an accelerated test lifetime of 682 hours at 7500 A/m², while sample Sm28 exhibits a lifetime of 708 hours, which is only slightly higher.

These results indicate that the amount of iridium incorporated in the polymeric procoatings produced from PBO should be reduced to less than 2 g Ir/m², and preferably should be about 0.5 up to about 1 g Ir/m².

TABLE 4

| REFERENCE | COATING Precoat. Soln. × No. Layers | Loading g/m² | HEAT TREATMENT II °C./min | III °C./min | ELECTROLYTIC TEST ACD A/m² | AP V/NHE | Time h |
|---|---|---|---|---|---|---|---|
| Me7 | PP6 × 8 | 5.2 PBO/2.0 IR | 300/120 | — | 1000 | 1.75-X | 6000 |
| | $MnO_2$ | 444 $MnO_2$ | | | | | |
| Me67 | PP6 × 15 | 5.2 PBO/2.0 Ir | " | — | 2500 | 1.85-X | 3330 |
| | $MnO_2$ | 423 $MnO_2$ | | | | | |
| Sm28 | PP6 × 8 | 5.2 PBO/2.0 Ir | " | — | 7500 | 2.06-X | 708 |
| | $MnO_2$ | 475 $MnO_2$ | | | | | |
| Me3 | PP6 × 4 | 2.6 PBO/1.0 Ir | " | — | 1000 | 1.76-X | 8600* |
| | $MnO_2$ | 443 $MnO_2$ | | | | | |
| Me6 | PP6 × 4 | 2.6 PBO/1.0 Ir | " | — | 2500 | 1.86-X | 3430 |

TABLE 4-continued

| REFERENCE | COATING Precoat. Soln. × No. Layers | Loading g/m² | HEAT TREATMENT II °C./min | III °C./min | ELECTROLYTIC TEST ACD A/m² | AP V/NHE | Time h |
|---|---|---|---|---|---|---|---|
| | $MnO_2$ | 444 $MnO_2$ | | | | | |
| Me42 | PP6 × 8 | 2.0 PBO/0.8 Ir | " | — | 4500 | 1.88-X | 820 |
| | $MnO_2$ | 456 $MnO_2$ | | | | | |
| Me68 | PP6 × 4 | 1.3 PBO/0.5 Ir | " | — | 1000 | 1.85-X | 6210* |
| | $MnO_2$ | 472 $MnO_2$ | | | | | |
| Me5 | PP6 × 2 | 1.2 PBO/0.5 Ir | " | — | 2500 | 1.90-X | 265 |
| | $MnO_2$ | 465 $MnO_2$ | | | | | |
| Sm26 | PP6 × 2 | 1.3 PBO/0.5 Ir | " | — | 7500 | 1.99-X | 682 |
| | $MnO_2$ | 477 $MnO_2$ | | | | | |
| Me46 | PP8 × 8 | 2.0 PBO-I/0.8 Ir | 300/120 | — | 4500 | 1.85-X | 707 |
| | $MnO_2$ | 444 $MnO_2$ | | | | | |
| Me44 | PP7 × 8 | 2.0 PBO-DPA/0.8 Ir | 300/120 | — | " | 1.85-X | 425 |
| | $MnO_2$ | 446 $MnO_2$ | | | | | |

EXAMPLE 5

Electrode samples with a manganese dioxide coating on a precoated titanium base were prepared and tested in the manner described in Example 1, unless indicated otherwise below.

The precoating solutions used in this example contained poly-p-phenylene (PPP) and, in one case, tetracyanoethylene (TCNE), as a polymer precursor dissolved in dimethylformamide (DMF). These solutions had the following constituents, expressed in mg per gram of solution:

PAP1:
- 16.4 mg PPP in DMF
- 14.8 mg Ir (as $IrCl_3$ aq.)

P62:
- 10.0 mg PPP in DMF
- 6.0 mg Ru (as $RuCl_3$ aq.)
- 2.0 mg Ir (as $IrCl_3$ aq.)

P63:
- 36.0 mg PPP in DMF
- 8.2 mg Ir (as $IrCl_3$ aq.)

P46:
- 16.4 mg TCNE in DMF
- 14.7 mg Ir (as $IrCl_3$ aq.)

The first heat treatment I on each layer applied to the samples in Table 5 below was effected under the following conditions: on samples 40.80 and F10 at 250° C. for 10 minutes in an air flow of 60 l/h, and on samples 73.80, 72.80 at 400° C. for 10 minutes in an air flow of 60 l/h.

Table 5 below shows the data corresponding to the samples of Example 5 in the same way as in the preceding tables.

Common heat treatments are indicated under II and III in Table 5 as before. As is likewise indicated under III, the precoated samples 51.81 and 53.81 were further subjected to a third common heat treatment at 400° C. for 6 and 3 hours, respectively.

A comparison of the data shown in Table 5 provides the following indications of interest with regard to the performance of manganese dioxide coated electrodes in accordance with the invention which comprise a polymeric precoating formed from poly-p-phenylene (PPP) as a polymer precursor.

Comparison of the data for samples 73.80 and 40.80 shows that sample 73.80, having a precoating prepared with a much higher ratio of PPP/Ir (about 4:1 for 73.80 vs. about 2:1 for 40.80) and a much lower iridium loading (0.3 g/m² for 73.80 vs. 1.1 g/m² for 40.80), exhibited an accelerated test lifetime at 7500 A/m² of 1030 hours, which is higher than the 860 hours achieved by sample 40.80. It may be noted that sample 73.80, which exhibited an improved test lifetime at 7500 A/m², had a precoating which was subjected to a heat treatment II at 400° for 20 minutes, as compared with 9.5 minutes in the case of sample 40.80.

The foregoing indicates that an increase of the proportion of polymeric material in the protective coating and of the duration of its heat treatment lead to an improvement of the electrode lifetime under extremely severe oxygen evolution conditions. On the other hand, it may be noted sample 40.80 exhibited an initial potential of 1.89 V/NHE which is lower than the 2.07 V/NHE of sample 73.80, and which could be explained by the nearly four times higher iridium loading of the precoating of sample 40.80 with respect to sample 73.80.

Comparison of sample 72.80 with sample 73.80 shows that an increase of the duration of the heat treatment II to 6 hours in the case of sample 72.80 leads to an accelerated test lifetime at 7500 A/m² of 1722 hours, while sample 73.80, which was prepared and tested under otherwise similar conditions achieved 1030 hours.

Samples 51.81 and 53.81 further show that ruthenium can be effectively used with a small loading (0.28 g Ru/m²) to replace most of the iridium, which is considerably reduced to less than 0.1 g Ir/m² in these samples.

Sample 51.81, which was subjected to a final heat treatment III of the precoating at 400° C. for 6 hours, exhibited an initial potential of 1.95 V/NHE, which is lower than for sample 53.81 (2.07 V/NHE) which underwent this heat treatment for 3 hours, but was otherwise prepared and tested in the same way and exhibited nearly the same accelerated test lifetime as sample 51.81.

Sample F10 in Table 5 finally shows that tetracyanoethylene can be effectively used as a polymer precursor to produce a precoating in accordance with the invention, and that the resulting electrode topcoated with 270 g $MnO_2$/m² exhibits an initial potential AP of 1.87 V/NHE and an accelerated test lifetime of 2650 hours at 2500 A/m².

TABLE 5

| REFERENCE | COATING Precoat. Soln. × No. Layers | Loading g/m² | HEAT TREATMENT II °C./min | III °C./min | ELECTROLYTIC TEST ACD A/m² | AP V/NHE | Time h |
|---|---|---|---|---|---|---|---|
| 40.80 | PAPI × 7 $MnO_2$ | 2.4 PPP/1.1 Ir 543 $MnO_2$ | 400/7.5 | — | 7500 | 1.98-X | 860 |
| 73.80 | P63 × 4 $MnO_2$ | 1.3 PPP/0.3 Ir 1100 $MnO_2$ | 400/20 | — | 7500 | 2.07-X | 1032 |
| 72.80 | P63 × 4 $MnO_2$ | 1.3 PPP/0.3 Ir 1240 $MnO_2$ | 400/360 | — | 7500 | 2.01-X | 1722 |
| 51.81 | P62 × 5 $MnO_2$ | 0.47 PPP/0.28 Ru/0.09 Ir 684 $MnO_2$ | 300/10 | 430/10 400/360 | 7500 | 1.95-X | 1270 |
| 53.81 | P62 × 5 $MnO_2$ | 0.47 PPP/0.28 Ru/0.09 Ir 649 $MnO_2$ | 300/10 | 430/10 400/180 | 7500 | 2.02-X | 1300 |
| F10 | P46 × 10 $MnO_2$ | 2.8 TCNE/2.5 Ir 270 $MnO_2$ | 300/30 | 400/7.5 | 2500 | 1.87-X | 2650 |

EXAMPLE 6

Electrode samples comprising a coating with at least one platinum group metal catalyst dispersed in a semiconducting polymer matrix formed on a precoated titanium base were prepared in the manner described in Example 1, unless indicated otherwise below.

The coating solutions P15, P15e and P58 applied to the samples in this example were previously described in Examples 1 and 3, respectively.

Table 6 below shows the data corresponding to the samples of this example in the same way as in the preceding examples.

As may be seen from Table 6 below, the polymeric precoating first applied contains a relatively small amount of platinum group metal catalyst, while the outer coating last applied has the highest loading of platinum group metal catalyst.

The sensitivity of sample 4 to manganese ions and fluoride ions was tested by adding 3 g/l $Mn^{2+}$ and 2 ppm $F^-$ to 180 g/l $H_2SO_4$ used as the test electrolyte in this case.

A comparison of the data shown in Table 6 provides the following indications of interest for producing electrodes with improved performance in accordance with the invention.

Comparison of samples 42.81, 43.81 and 57.81 shows that coated titanium electrodes with a reduced amount of noble metal catalyst corresponding to 1.2–1.7 g Ir/m² and 0.5–0.7 g Ru/m² exhibit an anode potential of 1.94 to 1.89 V/NHE and an accelerated test lifetime of 240–340 hours at 7500 A/m² in 150 g/l $H_2SO_4$. Comparison of sample 42.81 with sample 43.81, which were prepared under similar conditions except for a common heat treatment II of the topcoating of sample 42.81 at 400° C. for 1 hour, more particularly shows that this heat treatment leads to an accelerated test lifetime of sample 42.81 at 7500 A/m² of 340 hours, which is significantly higher than the 240 hours achieved by sample 43.81 which underwent no common heat treatment of the catalytic topcoating. Comparison of sample 57.81 with sample 43.81 moreover shows that such a common heat treatment II effected on the topcoating of sample 57.81 at 400° C. for 2 hours leads to an initial potential AP of 1.94 V/NHE and an accelerated test lifetime at 7500 A/m² of 258 hours, while the amount of iridium applied to sample 57.81 was at the same time reduced by about 0.5 g Ir/m² with respect to sample 43.81.

Sample 4 exhibited an initial potential AP of 1.65 V/NHE and a potential of 1.99 V/NHE after about 7 months operation as an oxygen evolving anode in 180 g/l $H_2SO_2$ containing 3 g/l $Mn^{2+}$ and 2 ppm $F^-$.

TABLE 6

| REFERENCE | COATING Precoat. Soln. × No. Layers | Loading g/m² | HEAT TREATMENT II °C./min | III °C./min | ELECTROLYTIC TEST ACD A/m² | AP V/NHE | Time h |
|---|---|---|---|---|---|---|---|
| W74 | P15 × 1 | 0.33 PAN/0.3 Ir | — | — | 2500 | 1.73-X | 2100 |
| | P58 × 4 | 1.2 PAN/0.7 Ru/0.2 Ir | 300/10 | 430/10 | | | |
| | P15 × 4 | 1.1 PAN/1.0 Ir | — | — | | | |
| 42.81 | P15e × 1 | 0.45 PAN/0.24 Ir | — | — | 7500 | 1.89-X | 340 |
| | P58 × 4 | 1.20 PAN/0.72 Ru/0.24 Ir | 300/10 | 430/10 | | | |
| | P15e × 4 | 2.2 PAN/1.2 Ir | 400/60 | — | | | |
| 43.81 | P15e × 1 | 0.45 PAN/0.24 Ir | — | — | 7500 | 1.89-X | 240 |
| | P58 × 4 | 1.2 PAN/0.72 Ru/0.24 Ir | 300/10 | 430/10 | | | |
| | P15e × 4 | 2.2 PAN/1.2 Ir | — | — | | | |
| 57.81 | P15e × 1 | 0.35 PAN/0.19 Ir | — | — | 7500 | 1.94-X | 258 |
| | P58 × 6 | 0.91 PAN/0.55 Ru/0.18 Ir | 300/10 | 430/10 | | | |
| | P15e × 3 | 1.57 PAN/0.84 Ir | 400/120 | — | | | |
| 4 | P15 × 1 | 0.33 PAN/0.3 Ir | — | — | 400 | 1.65–1.99 | 5600* |
| | P58 × 6 | 1.0 PAN/0.2 Ir | 300/10 | 430/10 | | | |
| | P15 × 4 | 1.3 PAN/1.2 Ir | — | — | | | |

EXAMPLE 7

Titanium electrode samples with a lead dioxide coating on a protective polymeric coating were prepared and tested in the manner described in Example 1, unless indicated otherwise below.

The precoating solutions P15 and P58 were prepared, applied and heat treated in the same way as described in Examples 1 and 3, respectively.

The precoated samples were topcoated by anodic deposition of lead dioxide from an electrolysis bath comprising 331 g/l $Pb(NO_3)_2$, 20 g/l $Cu(NO_3)_2$, 0.2 g/l surfactant (Triton, Trademark), and 5 g/l $HNO_3$. An electrolysis current corresponding to an anode current density of 20 mA/cm$^2$ was passed through the bath at 70° C. for 1.5 hours to electroplate sample M57. Sample M31 was electroplated at 15 mA/cm$^2$ and 45° C. for 2.5 hours, while sample N34a was electroplated as M57 but with a duration of 2.25 hours.

Samples M57 and M31 were tested for anodic oxygen evolution in aqueous solutions (with very low conductivity) containing organic impurities. Sample N34a was tested in 150 g/l $H_2SO_4$.

Table 6 below shows data corresponding to these samples in the same way as in the preceding tables.

TABLE 7

| | COATING | | HEAT TREATMENT | | ELECTROLYTIC TEST | | |
|---|---|---|---|---|---|---|---|
| | Precoat. | | | | | | |
| REFERENCE | Soln. × No. Layers | Loading g/m$^2$ | II °C./min | III °C./min | ACD A/m$^2$ | AP V/NHE | Time h |
| M57 | P58 × 4 $PbO_2$ | 0.5 PAN/0.3 Ru/0.1 Ir 900 $PbO_2$ | 300/7.5 | 430/7.5 | 2000 | 2.17-X | 1440 |
| M31 | P58 × 4 P15 × 4 $PbO_2$ | 0.5 PAN/0.3 Ru/0.1 Ir 1.2 PAN/1.1 Ir 1340 $PbO_2$ | 300/7.5 — | 430/7.5 — | 1500 | 2.16-X | 2590 |
| N34a | P58 × 7 $PbO_2$ | 0.9 PAN/0.5 Ru/0.2 Ir 1260 $PbO_2$ | 300/7.5 | 430/7.5 | 7500 | 2.55-X | 680 |

The test data in the examples above show that electrodes according to the invention exhibit a high resistance to oxidation during prolonged evolution of oxygen in acid under severe anode operating conditions.

Electrodes with a titanium base may thus be provided with a protective polymeric intermediate coating in accordance with the invention, so as to significantly increase their stability with regard to electrochemical passivation, so as to exploit more fully the proven advantages of using an electrode base of titanium, and to thereby significantly increase the service life of the electrodes in various industrial electrolytic processes. It is understood, however, that such a protective polymeric intermediate coating may be applied advantageously in a similar manner to protect an electrode base consisting of any other suitable valve metal such as zirconium, tantalum, or niobium. Such protective polymeric intermediate coating may moreover be applied to protect an electrode base of any other suitable, non-film forming metal, or even a non-metallic electrode base material such as graphite, from corrosion.

As may be seen from the examples above, very small amounts of platinum group metal may be effectively incorporated in the protective polymeric intermediate coating of the electrode according to the invention. Such a protective polymeric coating may be effectively combined with any stable outer coating suitable for carrying out a desired electrolytic process.

This outer coating may advantageously comprise a platinum group metal catalyst, while said protective polymeric intermediate coating serves to protect the electrode base from oxidation, to thereby increase the service life of the electrode, whereby to achieve more economical use of the precious metal. Thus for example electrodes with a catalytic outer coating of titanium-ruthenium oxide, or titanium-ruthenium-tin oxide, previously discussed under the heading Background Art, may likewise be protected from passivation by providing their titanium base with a protective polymeric intermediate coating in accordance with the invention.

This may be illustrated by an electrode which was provided, in accordance with the invention, with a protective polymeric coating formed on a titanium base from polyacrylonitrile and iridium chloride (2 g Ir/m$^2$) as described in the examples above, and provided with a catalytic outer coating of titanium-ruthenium-tin oxide, as previously discussed under the heading Background Art.

Such an electrode was anodically tested at 300 A/m$^2$ in water containing 2 g/l NaCl, while the current was periodically reversed to −50 A/m$^2$ for 15 minutes every 12 hours. It exhibited an anode potential of 1.45 V/NHE at 400 A/m$^2$, and withstood this test with current-reversal for 750 hours in this very dilute solution at ambient temperature.

Electrodes, which were produced in accordance with the invention and comprise a coating of manganese dioxide or lead dioxide, have also shown promising results during anode operation under industrial test conditions.

It may thus be seen that the invention is not essentially restricted to given types of electrode materials and specific manufacturing conditions, i.e. the materials and manufacturing conditions described in the examples above merely serve to illustrate several modes of carrying out the invention.

INDUSTRIAL APPLICABILITY

Electrodes produced in accordance with the invention may be advantageously applied to various electrolytic processes where inexpensive, stable, oxidation-resistant electrodes with a valve metal base are required.

They may be advantageously applied as anodes intended for operation under conditions where oxygen is anodically evolved, more particularly in acid electrolyte.

Electrodes according to the invention, which have a manganese dioxide coating, may be advantageously applied as inexpensive oxygen evolving anodes of reduced weight and volume operating at a reduced voltage with no contamination of the electrolyte, and hence may be advantageously used, instead of conventional lead or lead alloy anodes currently employed, in processes for electrowinning metals such as Cu, Zn, Co, Ni, Cr from acid electrolytes.

Electrodes according to the invention which have a lead dioxide coating may be advantageously used as insoluble anodes for electrolysis in aqueous solution containing organic substances, fluoride, chloride, bromide, chlorate, sulfate, nitrate, cyanide, carbonate, oxalate, chromate and bichromate may be used in processes for the recovery, refining and electrowinning of metals such as Cu, Zn, Co, Ni, Cr. They may also be usefully applied in processes for chromic acid production, chromium plating, perborate, persulfate, or perchlorate production, oxidation of iodic acid. They may likewise be usefully applied as anodes for electrolflotation, or for organic oxidation reactions requiring a relatively high oxygen overvoltage.

We claim:

1. A method of manufacturing an anode comprising a stable outer coating effective for carrying out an electrolytic process and a protective intermediate coating formed on an anode base consisting essentially of titanium, characterized by the steps of:

(a) forming said protective intermediate coating by: applying to said anode base successive layers of a homogeneous solution of at least one thermally decomposable compound of a platinum group metal and an organic precursor compound selected from the group consisting of polyacrylonitrile, polybenzoxazole and poly-p-phenylene; drying each of said layers; and subjecting the dried layers to heat treatment in an oxidizing atmosphere, in such a manner as to thermally convert said organic precursor compound into a conducting insoluble polymer network adhering to the anode base, while said metal compound is thermally converted to a platinum group metal oxide finely dispersed throughout said conducting insoluble network formed in situ on the anode base, and so as to thereby provide said protective intermediate coating adhering to said anode base; and (b) forming on the protective intermediate coating thus formed said stable outer coating effective for carrying out an electrolytic process.

2. The method of claim 1, characterized in that said heat treatment is effected in an oxidizing atmosphere such as air up to a temperature in the range between 250° C. and 450° C.

3. The method of claim 2, characterized in that the duration of said heat treatment in said temperature range lies between 5 and 360 minutes.

4. The method of claim 3, characterized in that, after applying and drying each of said successive layers, a first heat treatment (I) is effected in an oxidizing atmosphere at a temperature in the range from about 250° C. to about 400° C.

5. The method according to claim 1, for the manufacture of an electrode comprising an outer coating of manganese dioxide, characterized in that said outer coating of manganese dioxide is electrodeposited on said protective intermediate coating with a conducting, insoluble polymer network formed in situ on the electrode base, and that said coating of electrodeposited manganese dioxide is subjected to heat treatment at a temperature of about 400° C. to improve the electrochemical performance of said electrode.

6. The method of claim 5, characterized in that the amount of electrodeposited manganese dioxide corresponds to at least 100 grams per square meter of the electrode base, and preferably corresponds to 300–500 $g/m^2$.

7. The method according to claim 1, for the manufacture of an electrode comprising an outer coating of lead dioxide, characterized in that said outer coating of lead dioxide is electrodeposited on said protective intermediate coating with a conducting insoluble polymer network formed in situ on the electrode base.

8. The method of claim 7, characterized in that the amount of electrodeposited lead dioxide corresponds to at least 300 grams per square meter of the electrode base and preferably corresponds to 800–1500 $g/m^2$.

* * * * *